US011071400B1

(12) United States Patent
Khan

(10) Patent No.: US 11,071,400 B1
(45) Date of Patent: Jul. 27, 2021

(54) BOWL WITH SUCTION DEVICE AND METHOD OF USE

(71) Applicant: Faisal Khan, Frisco, TX (US)

(72) Inventor: Faisal Khan, Frisco, TX (US)

( * ) Notice: Subject to any disclaimer, the term of this patent is extended or adjusted under 35 U.S.C. 154(b) by 0 days.

(21) Appl. No.: 15/821,829

(22) Filed: Nov. 23, 2017

Related U.S. Application Data

(60) Provisional application No. 62/426,049, filed on Nov. 23, 2016.

(51) Int. Cl.
*A47G 19/10* (2006.01)

(52) U.S. Cl.
CPC ..... *A47G 19/10* (2013.01)

(58) Field of Classification Search
CPC ..... A47G 19/10; A47G 29/093; A47G 19/02; A47G 23/0225; F16B 47/00; B65D 21/0222
USPC ..... 220/574
See application file for complete search history.

(56) References Cited

U.S. PATENT DOCUMENTS 3,476,261 A * 11/1969 McCutcheon ..... A47G 19/10 211/74
6,318,683 B1 * 11/2001 Savoy ..... A47D 1/008 248/146
2010/0276433 A1 * 11/2010 Dauerman ..... A47G 19/10 220/574
2012/0104214 A1 * 5/2012 St. Jacques ..... A47J 36/34 248/346.5
2013/0320164 A1 * 12/2013 Pyon ..... F16B 47/00 248/206.3
2014/0326630 A1 * 11/2014 Henry ..... A47G 19/02 206/503
2015/0230638 A1 * 8/2015 Jagger ..... A01K 7/005 220/574
2016/0256002 A1 * 9/2016 Potter ..... A47G 1/17

* cited by examiner

*Primary Examiner* — Shawn M Braden
(74) *Attorney, Agent, or Firm* — Leavitt Eldredge Law Firm

(57) ABSTRACT

A container system includes a container having a body forming an inner area to hold contents therein, the container having an outer surface that extends from a top surface to a bottom surface; and an attachment device secured to the bottom surface of the container, the attachment device having an elastomeric body configured to engage with a surface of a support structure to secure the attachment device to the surface of the support structure; the attachment device secures the container to the support structure.

4 Claims, 4 Drawing Sheets

BOWL WITH SUCTION DEVICE AND METHOD OF USE

FIELD OF THE INVENTION

The present invention relates generally to bowls, plates, cups and the like and methods to secure them to a support structure such as a table.

DESCRIPTION OF RELATED ART

Bowls, plates, cups, and the like are well known in the art. FIG. 1 depicts a side view of a conventional bowl 101 having a contoured body 103 that forms an opening 105 and having a bottom surface 107 for resting on a support structure such as a table top.

Although effective in most applications of use, bowl 101 has significant disadvantages. For example, bottom surface 107 has a tendency to slide and fall off the table top as a child attempts to eat the food contained within the inner cavity formed by the contoured body 103. Some bowls have non-slip surface treatments on surface 107 to prevent slipping.

Although great strides have been made in the area of attempting to keep the bowl 101 from sliding and spilling the contents therein, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
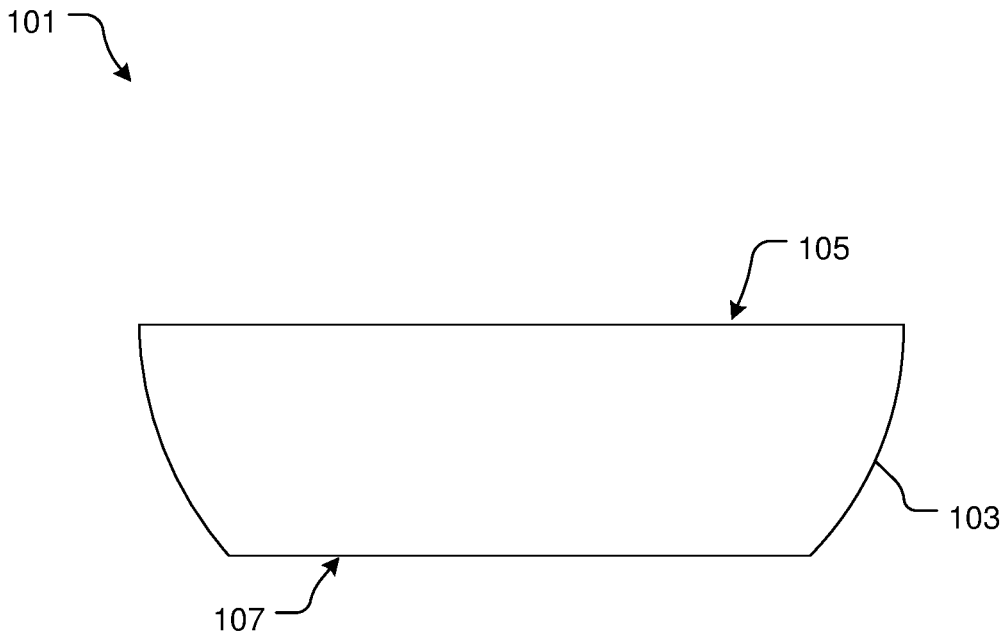
FIG. 1 (Prior Art)
FIG. 1 is a side view of a conventional bowl.
Figure 2:
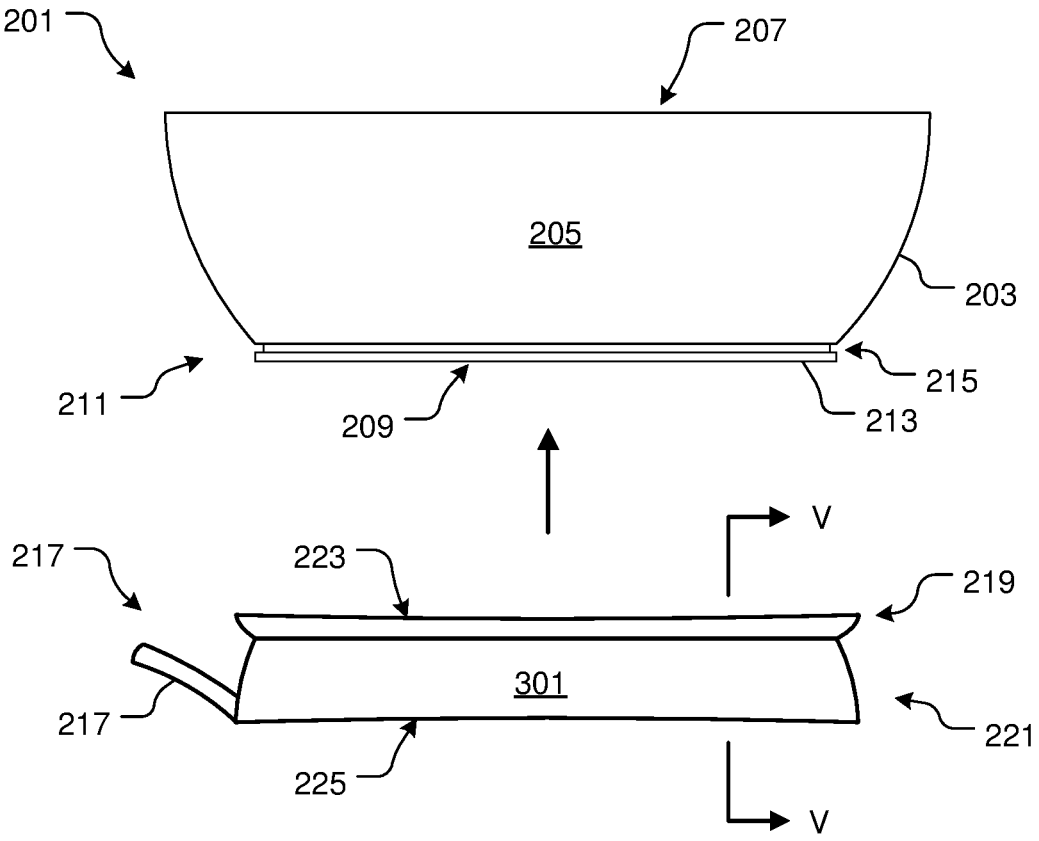
FIG. 2 is a disassembled side view of a bowl and suction device in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another.

Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional bowls, plates, cups and the like. Specifically, the bowl of the present invention includes a suction device secured to a bottom surface and configured to secure the bowl to a top surface of a support structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-7 depict various views of a bowl 201 in accordance with a preferred embodiment of the present application. It will be appreciated that bowl 201 overcomes one of more of the above listed problems commonly associated with the conventional bowls. Although shown with a bowl, it should be understood that the features discussed herein could be used on other types of containers, including but not limited to plates, cups, and so forth.

In one of the contemplated embodiment, bowl 201 includes a contoured body 203 the forms an inner area for holding contents therein. The body 203 has an outer surface 205 that extends from a top surface 207 to a bottom surface 209.

Figure 3:
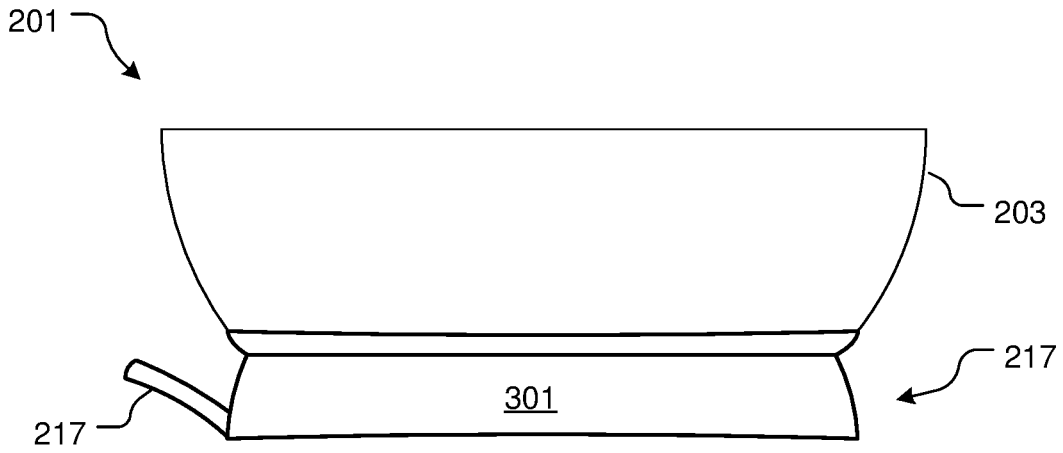
FIGS. 3 and 4 are side assembled views of the bowl of FIG. 2.

The bowl 201 further includes an attachment device 211, which in the preferred embodiment is a rim 213 offset from bottom surface of the bowl and forms a channel 215 that extends the periphery of the bottom surface. In the preferred embodiment, the channel 215 is configured to provide means for a suction device 217 to removably secure to the bottom surface of the bowl, as depicted in FIG. 3.

Figure 4:
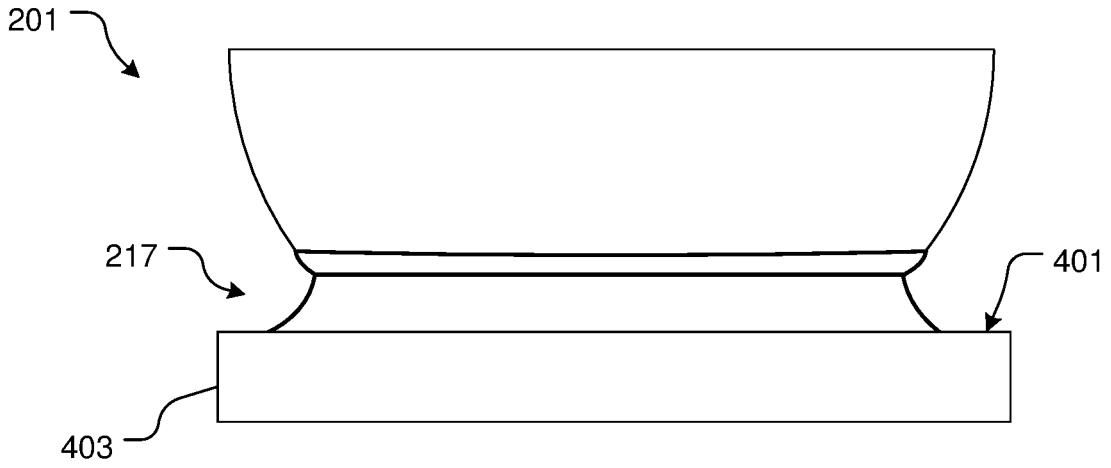

The suction device 217 includes a body composed of an elastomeric material. The body comprises of an upper section 219 configured to engage with surface 205 and a lower section 221 configured to elastically stretch and to engage with a top surface 401 of a support structure 403, e.g., a table, as depicted in FIG. 4.

Figure 5:
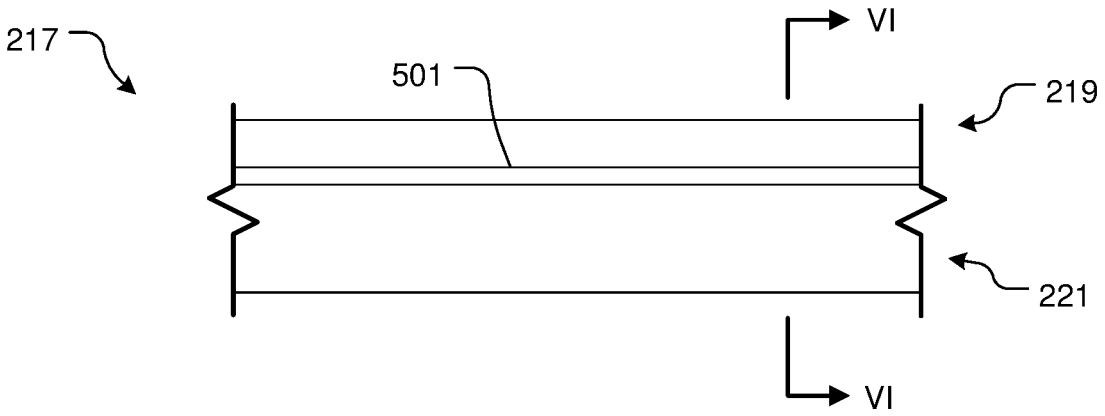
FIG. 5 is a front view of the suction device taken at V-V of FIG. 2.
Figure 6:
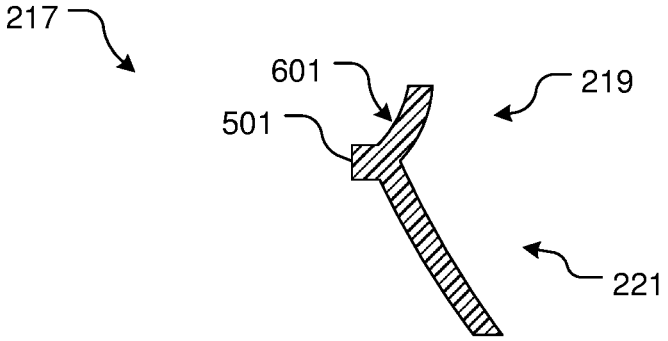
FIG. 6 is a cross-sectional view of the suction device taken at VI-VI of FIG. 5.

In the preferred embodiment, the body of suction device 217 extends from a first opening 223 to a second opening 225 and forms a hollow interior, as depicted in front and cross-sectional views of FIGS. 5 and 6.

An optional tab 217 is integral with the body of suction device 217 and extends outwardly from an outer surface 301 of the suction device 217. During use, the tabe 217 is configured to assist the user apply pressure direction to the lower section 221 of the suction device 217, which in turn breaks the suction seal between the lower section and the top surface of the support structure.

As depicted in FIG. 6, a rim 501 extends outwardly from a section of the suction device wherein the upper section 219 and the lower section 221 meet. The rim extends the periphery inner length of the suction device 217 and is configured to snugly fit within the channel 215 of the attachment device 211.

Figure 7:
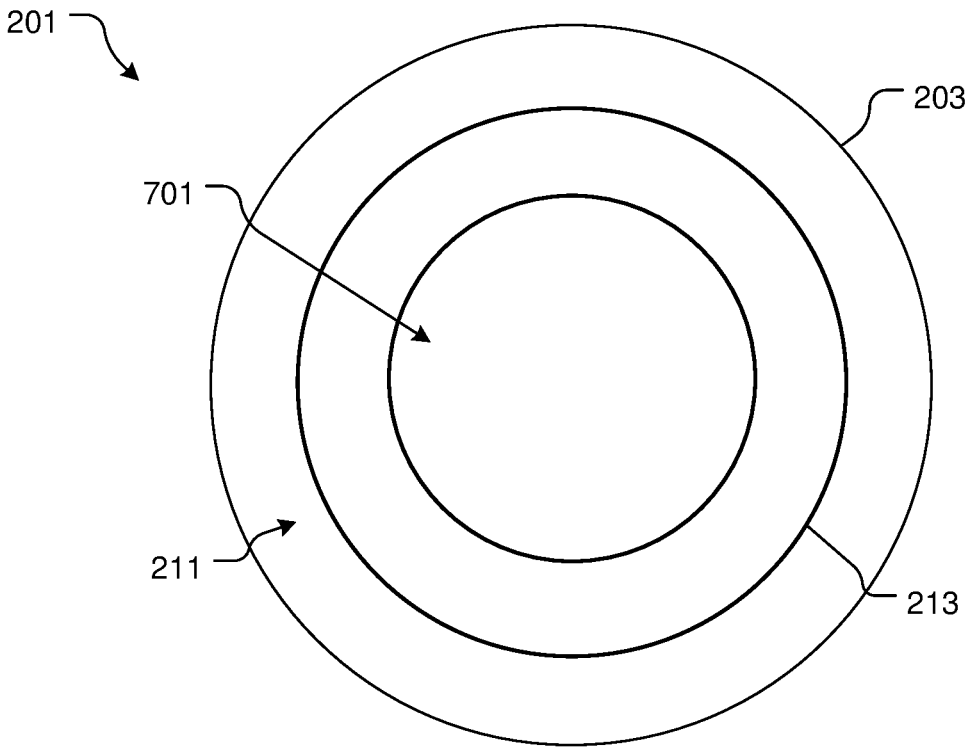
FIG. 7 is a bottom view of the bowl and the suction device.

A bottom view of bowl 201 is shown in FIG. 7. It will be appreciated that a cavity 701 is formed from the bottom surface of the bowl and is used to create a stronger suction area between the suction device and the support structure being secured thereto. It should be understood that area 701 is an optional feature and alternative embodiments could include a continuous flat surface in lieu of creating a cavity 701.

Figure 8:
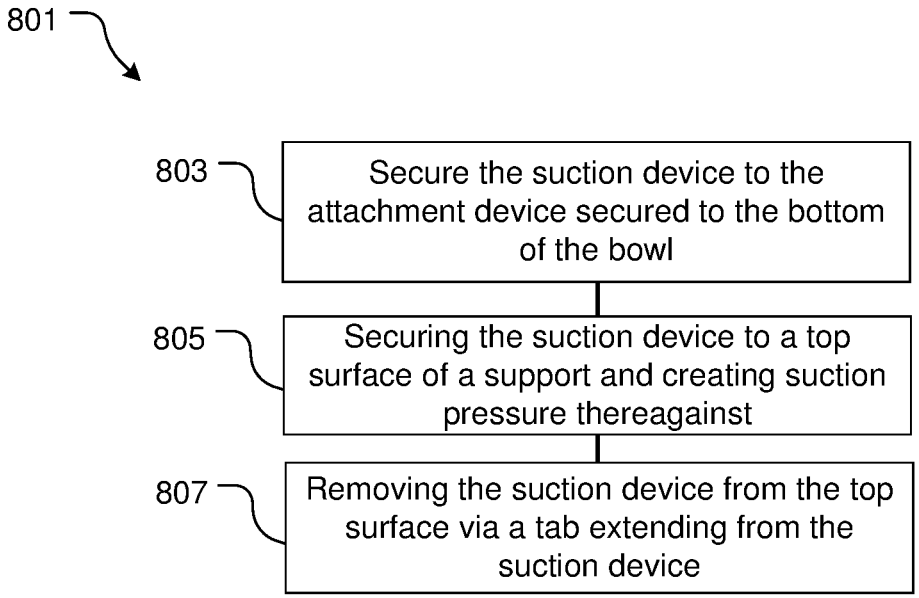
FIG. 8 is a flowchart of the preferred method of use.

Referring to FIG. 8, a flowchart 801 of the method of use is shown. The method includes the steps of securing the suction device to the bowl and thereafter securing the suction device to a top surface of the support structure. Thereafter, a suction seal is created with downward force and the bowl is secured in position on the top surface of the support structure. To remove the bowl, a tab secured to the suction device is pulled, which in turn breaks the suction seal. These features are shown in boxes 803-807 of the flowchart 801.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A container system, comprising:

a container having a body forming an inner area configured to hold contents therein, the container having an outer surface that extends from a top surface to a bottom surface, the bottom surface having a rim that extends from an outer surface of the bottom surface and forms a channel; and an attachment device removably secured to the bottom surface of the container, the attachment device having an elastomeric body configured to engage with a surface of a support structure to secure the attachment device to the surface of the support structure, the attachment device having:

an upper section integral with a lower section, the upper section is configured to removably engage with the bottom surface of the body; and a rim disposed between the upper section and the lower section, the rim is configured to removably secured to the rim of the body;

wherein the attachment device secures the container to the support structure.

2. The system of claim 1, wherein the container is a bowl.

3. The system of claim 1, wherein the attachment device comprises:

the elastomeric body having a first opening to receive the container therein and a second opening opposite the first opening;

wherein the second opening creates suction when engaged with the surface of the support structure to secure the attachment device thereto.

4. The system of claim 1, further comprising:

a tab extending from the attachment device.

* * * * *